US006324818B1

(12) United States Patent
Morness et al.

(10) Patent No.: US 6,324,818 B1
(45) Date of Patent: Dec. 4, 2001

(54) VACUUM FILLING MACHINE FOR BAGS

(75) Inventors: Thomas Morness, Owatonna; Brent Crump, Austin; Laverne N. Wobschall, Owatonna; Gil Wambeam, Austin, all of MN (US)

(73) Assignee: Slidell, Inc., Owatonna, MN (US)

( * ) Notice: Subject to any disclaimer, the term of this patent is extended or adjusted under 35 U.S.C. 154(b) by 0 days.

(21) Appl. No.: 09/586,458

(22) Filed: Jun. 3, 2000

Related U.S. Application Data

(63) Continuation-in-part of application No. 09/409,099, filed on Sep. 30, 1999, and a continuation-in-part of application No. 09/251,603, filed on Feb. 17, 1999.

(51) Int. Cl.[7] ..... B65B 1/06; B65B 7/06; B65B 31/04

(52) U.S. Cl. ..... 53/512; 53/284.7; 53/374.5

(58) Field of Search ..... 53/284.2, 374.3, 53/374.5, 374.6, 374.7, 374.9, 375.2, 551, 571, 512; 141/263, 251

(56) References Cited

U.S. PATENT DOCUMENTS

| | | | | |
|---|---|---|---|---|
| 1,889,193 | | 11/1932 | Craig . | |
| 2,310,382 | | 2/1943 | Allen . | |
| 2,608,333 | | 8/1952 | Marziani . | |
| 2,766,782 | | 10/1956 | Bell . | |
| 2,960,808 | * | 11/1960 | Pike | 53/551 |
| 3,063,890 | | 11/1962 | Saumsiegle . | |
| 3,326,097 | | 6/1967 | Lokey . | |
| 3,488,915 | | 1/1970 | Delestatius . | |
| 3,668,815 | * | 6/1972 | Henry | 53/551 |
| 3,889,449 | | 6/1975 | Membrino . | |
| 4,019,305 | | 4/1977 | McGhie . | |
| 4,185,669 | | 1/1980 | Jevakohoff . | |
| 4,265,696 | | 5/1981 | Graves . | |
| 4,332,932 | | 6/1982 | McGregor . | |
| 4,432,186 | | 2/1984 | McGregor . | |
| 4,510,736 | | 4/1985 | Muller . | |
| 4,523,753 | * | 6/1985 | Kovacs | 53/551 |
| 4,526,214 | | 7/1985 | McGregor . | |
| 4,612,965 | | 9/1986 | McGregor . | |
| 4,884,389 | | 12/1989 | McGregor . | |
| 5,109,894 | | 5/1992 | McGregor . | |
| 5,349,996 | | 9/1994 | McGregor . | |
| 5,448,879 | | 9/1995 | Concetti . | |
| 5,535,792 | | 7/1996 | McGregor . | |
| 5,768,863 | | 6/1998 | McGregor . | |
| 5,771,667 | | 6/1998 | McGregor et al. . | |

* cited by examiner

*Primary Examiner*—John Sipos
(74) *Attorney, Agent, or Firm*—Moore & Hansen

(57) ABSTRACT

A device for automatically vacuum filling and sealing bags comprising a bag handling and sealing mechanism that is moveable between a first, bag receiving position in close proximity to a material discharge spout and a second, bag discharge position away from the spout. The material discharge spout is provided with one or more vacuum probes that draw a vacuum within a bag clamped within a pair of forming bars of the bag handling and sealing mechanism. Once a vacuum has been drawn within the bag, the bag handling and sealing mechanism seals the bag and moves it to a bag discharge position away from the spout where the bag is deposited on a bag removal mechanism such as a conveyor.

3 Claims, 15 Drawing Sheets

VACUUM FILLING MACHINE FOR BAGS

This application is a Continuation in Part of U.S. patent application Ser. No. 09/409,099, filed Sep. 30, 1999 and commonly assigned herewith. This application is also a Continuation in Part of U.S. patent application Ser. No. 09/251,603, filed Feb. 17, 1999 and also commonly assigned herewith.

BACKGROUND OF THE INVENTION

Summary of the Invention

This invention relates to fully automated bag handling and filling machines which pick up bags one at a time from a supply source, fill the bags, draw a vacuum in the bags and release them in an integrated, high speed, and efficient system. More particularly, this invention is drawn to an apparatus for bottom filling and/or vacuum sealing both paper and plastic type bags within a fully automated bag handling and filling machine.

Automated bag handling and filling machines are known in the art. See, for example, U.S. Pat. Nos. 4,322,932, 4,432,186, and 4,612,965 issued to Harold R. McGregor. Traditionally, bag handling and filling machines have utilized bag holding clamps on a clam shell type of filling spout to hold the bag during a filling operation on the spout, with the filled bag then being conveyed to a separate, closing machine for closing the bag top, as by stitching or by heat sealing. Bag control and forming bars have been incorporated to grip the bag mouth, after filling, and to lower it onto a conveyor, which serves to transport the filled bag to a separate, bag closing station. Such bag handling and control bars are shown, for example, in U.S. Pat. No. 4,322,932. Recognizing that operating efficiencies including more compact machine footprints and reduced operational costs could be realized by incorporating the bag sealing function within a single machine for handling, filling, and sealing bags, such integrated machines have been developed. For an example of such an integrated machine see U.S. Pat. No. 5,771,667 issued to Harold R. McGregor.

However, bag sealing apparatuses for such integrated bag handling and filling machines have been limited in the manner in which bags could be filled and closed. Consequently, a bottom filling apparatus for filling bags from the bottom up and a bag sealing apparatus capable of handling and closing both plastic bags and paper bags have been developed. This apparatus has also been adapted for vacuum sealing plastic bags or paper bags with plastic liners.

OBJECTS OF THE INVENTION

A first objective of this invention is to provide a filling mechanism that allows a bag to be filled from the bottom up. Another objective of this invention is to provide a bag sealing apparatus which is capable of handling and closing both plastic and paper bags. Yet another objective of this invention is to provide an integrated bag filling machine which is capable of both filling, sealing, and handling bags and which occupies a minimum of space on a factory floor. A further objective of this invention is to provide a bag closing apparatus capable of handling and closing both plastic and paper bags and which may be mounted in a number of ways, including on a vertically moveable carriage or from an overhead support structure. Yet another objective is to provide a material discharge spout and bag handling and sealing mechanism that may vacuum seal plastic bags and paper bags with plastic liners.

BRIEF SUMMARY OF THE INVENTION

An apparatus for vacuum filling and sealing bags may comprise a material dispensing spout for discharging particulate material into a bag. The spout has a discharge end defined by closure members or clamshell halves, operable between closed and open positions. An actuator means is positioned and arranged to open and close the clamshell halves of the spout. Clamping members on the discharge end of the spout are movable between a closed position in which the clamping members clamp a bag mouth on the spout discharge end and an open position in which a bag mouth may be removed from, or addressed to, the spout discharge end. At least one vacuum probe is disposed along the material dispensing spout in such a manner that the vacuum probe will be disposed within a bag mouth that is positioned on the spout discharge end. The vacuum probe has a source of negative pressure fluidically coupled thereto for drawing a vacuum within the bag.

A carriage having a sealing apparatus mounted therein is positioned such that when the carriage may be moved along a travel path between a first, bag receiving position in which the carriage is in close proximity to the spout discharge end and a second, bag discharge position in which the carriage is away from the spout. The sealing apparatus is movable between a first, inoperative position and a second position in sealing juxtaposition with the bag mouth. In operation the bags are clamped on the spout and filled one at a time, and thereafter released by the spout clamping members for movement by the carriage to a release position. The bag mouth is sealed by the sealing apparatus as the carriage moves between its first and second positions, The sealing apparatus itself comprises a pair of opposable forming bars for gripping and supporting a bag, the forming bars being rotatively disposed between a pair of parallel side plates. The forming bars are constructed and arranged to resiliently seal the bag mouth in an airtight manner around the vacuum probe when the carriage is in close proximity to the spout discharge end of the spout. A pair of sealing bars are rotatively mounted beneath the forming bars in such a manner they may rotate between a first position in which the sealing bars are rotated away from the bag and a second position in which the sealing bars engage the bag to heat seal said bag.

A settling bar may also be added to the carriage for settling the particulate materials within the bag. Such a settling bar is rotatively coupled to the carriage and is constructed and arranged to be positioned so that said settling bar may contact the bag as the carriage is moved into its first, bag receiving position. The contact between the bag and settling arm acts to remove air disposed within the particulate material.

Another embodiment of a bag sealing mechanism for sealing bags comprises a pair of opposable forming bars for gripping and supporting a bag, a pair of opposable crimping bars for forming a transverse crease in the bag, and a settling bar. The pairs of forming and crimping bars and the settling bar are rotatively disposed between a pair of parallel side plates. A pair of sealing bars are rotatively mounted beneath the forming bars in such a manner they may rotate between a first position in which the sealing bars are rotated away from the bag and a second position in which the sealing bars engage the bag to heat seal said bag. The settling bar is constructed and arranged to be positioned above said pairs of forming and crimping bars so that the settling bar may contact the bag as the bag sealing mechanism is moved into a position in which the pairs of forming and crimping bars may operatively engage a bag.

In addition, a fold-over bar may be secured above one of the pair of crimping bars for folding over the top of a bag where the side of the bag is coated with an adhesive. The fold-over bar is constructed and arranged to rotate between a first, upper position and a second, lower position in which the fold-over bar folds a portion of the bag above the transverse crease formed by the crimping bars against a portion of the bag below said transverse crease, the adhesive being applied to the side of the bag below the transverse crease. In order to improve the sealing contact between the foldover bar and the side of the bag, the fold-over arm rotates between its first and second positions along a complex curvilinear path.

These and other objectives and advantages of the invention will appear more fully from the following description, made in conjunction with the accompanying drawings wherein like reference characters refer to the same or similar parts throughout the several views.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
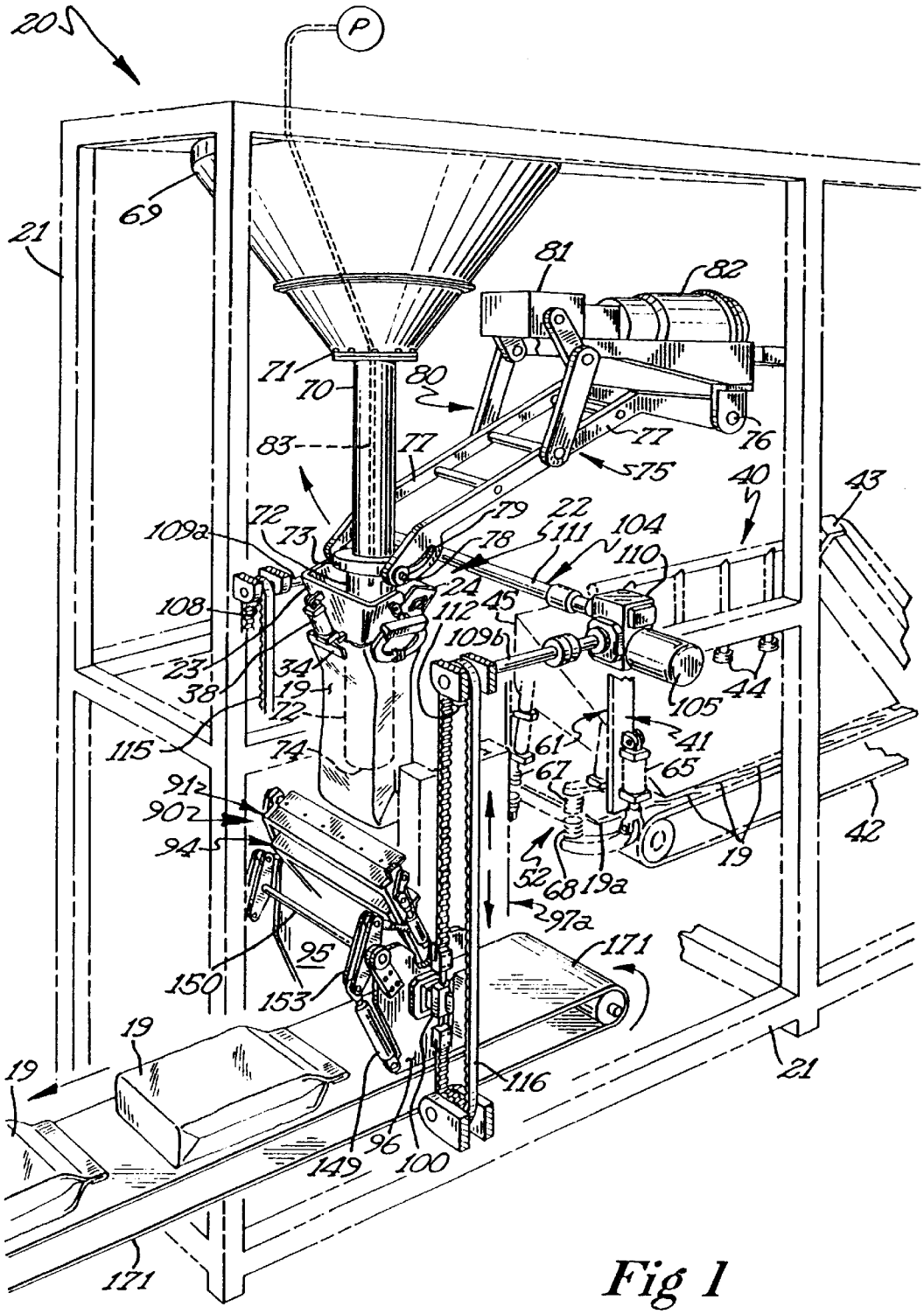
FIG. 1 is a perspective view of a compact bag filling machine of the type which may incorporate a moveable spout carriage constructed.

FIG. 1 is a perspective view of a compact bag filling machine of a type described in copending U.S. patent application Ser. No. 09/409,099, hereby incorporated by reference. In the bag filling machine 20 illustrated in FIG. 1, a bag 19 is secured to a stationary spout 22 which is supported on a framework 21. In order to bottom-fill the bag 19, a slip tube 72 is inserted through the open spout 22 into the bag and material from a supply hopper 69 is allowed to pass through the slip tube 72 and into the bag 19. The slip tube 72 is withdrawn from the bag 19 as the bag fills from the bottom up. A lever arm 75 that is actuated between an upper and a lower vertical position by a rotary linkage 80 moves the slip tube 72 between its upper position in which the slip tube is outside of the bag 19, and its lower position in which the slip tube 72 is inserted through the spout 22. While this arrangement is perfectly capable of filling a bag 19, it is preferred to utilize a stationary slip tube 202 as illustrated in FIG. 2. Alternatively, a vertical bottom fill auger assembly as disclosed in U.S. Pat. No. 5,109,894, the disclosure of which is hereby incorporated by reference, may be used in place of the slip tube assembly described above.

The use of stationary slip tube 202 is facilitated by mounting a spout 201 upon a moveable spout carriage 200. In this manner, when the spout carriage 201 is in its first, lower position, the stationary slip tube 202 will be disposed outside and above the spout 201. When the spout carriage 200 is moved to its second, upper position and the spout 201 is open and has a bag 19 clamped thereto, the stationary slip tube 102 will be inserted through the spout 201 and into the bottom of the bag 19. In this manner, a predetermined charge of particulate material from a supply hopper 69 may be introduced into the bottom of the bag 19 through a stationary slip tube 202. As the bag 19 fills, the spout carriage 200 will move downward to its first position, thereby bottom filling the bag as described in U.S. patent application Ser. No. 09/409,099.

Figure 3:
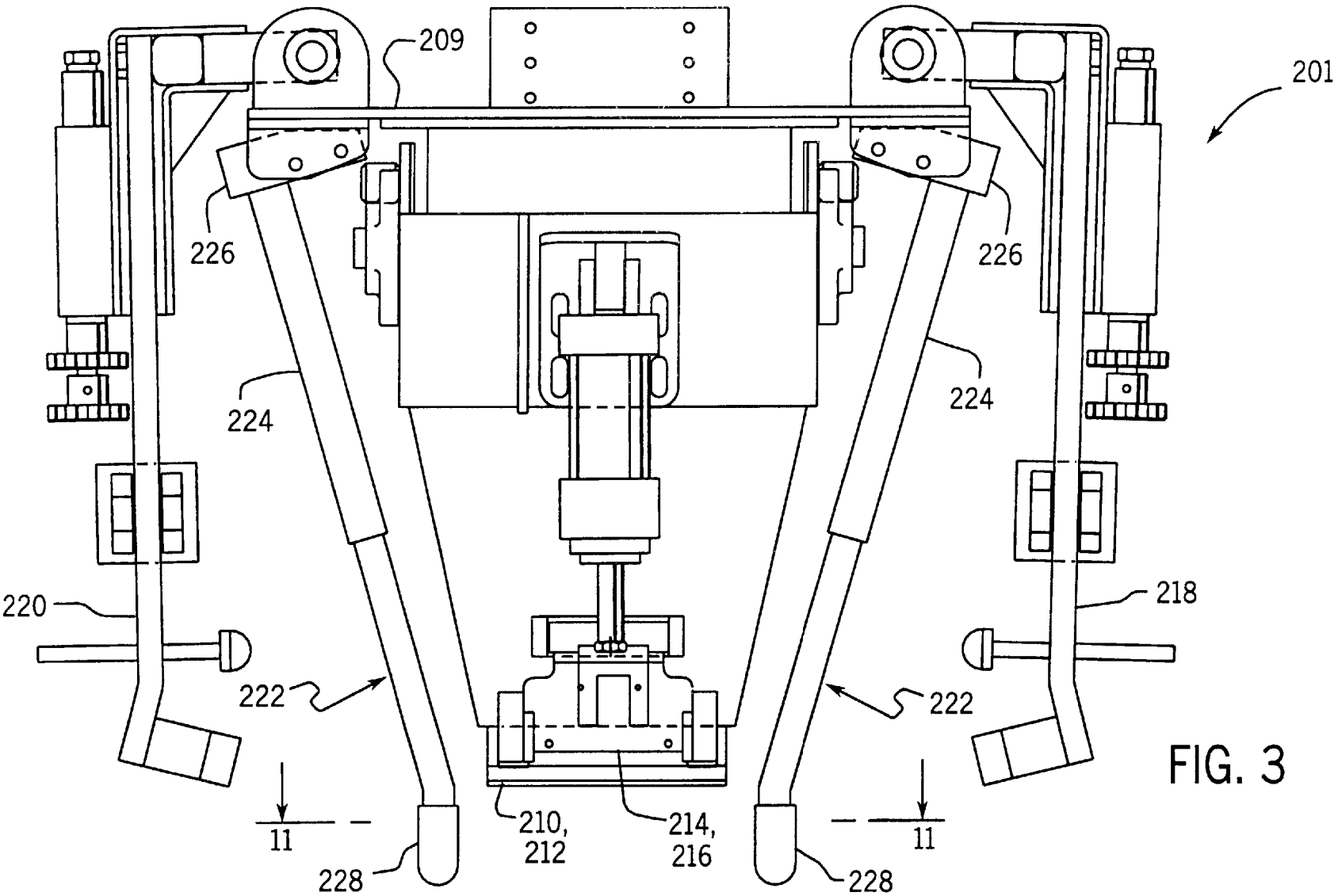
FIG. 3 is a front elevation of a bag filling spout having means for drawing a vacuum in a bag coupled thereto.
Figure 4:
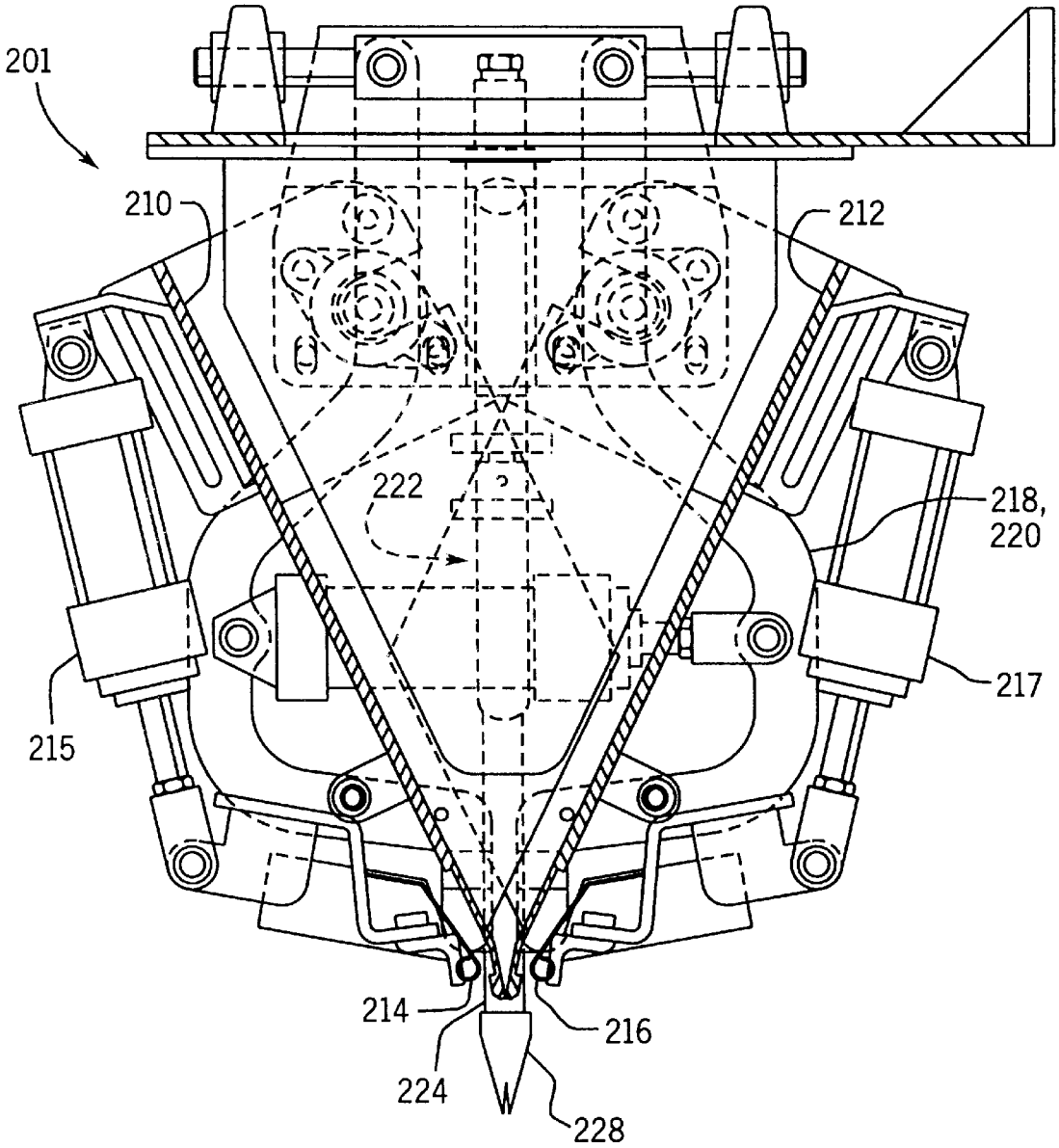
FIG. 4 is a side elevation showing a bag filling spout with spout clamps and means for drawing a vacuum in a bag being filled.

The spout 201 may vary in its structure according to the needs of a particular application, but is essentially the same as the material discharge spouts described in U.S. Pat. Nos. 4,322,932 (Bag Filling and Handling Apparatus), 4,526,214 (Bag Filling Apparatus), 5,349,996 (Bag Filling Apparatus Having Dust-Tight Spout), and 5,771,667 (Bag Filling, Closing, and Sealing Machine), all of which were issued to Harold McGregor and are commonly assigned with the present application. The disclosures of U.S. Pat. Nos. 4,322,932, 4,526,214, 5,349,996, and 5,771,667 are hereby incorporated by reference. A typical spout 201 is illustrated in FIG. 3.

As the general structure and function of the spout 201 has been adequately described in the aforementioned incorporated patents, only a cursory description of the spout 201 will be given herein. The spout 201 essentially comprises a pair of rotating clam shells 210 and 212. The clam shells are rotatable between a first, closed position in which the clam shells are in sealing contact with one another, and a second, open position in which the clam shells 210, 212 have been rotated away from each other. Each clam shell half 210, 212 has a bag clamp 214, 216 coupled thereto near its lower lip. The bag clamps 214, 216 act to secure the mouth of a bag 19 to the mouth of the spout 201 for filling and are actuated by power cylinders 215, 217, repsectively. The spout 201 may also have bag gripping and manipulation members 218, 220 coupled to the spout at its lateral edges. These bag gripping and manipulation members 218, 220 are useful for manipulating the mouth of a bag 19 to open or close the bag mouth as the spout clam shell halves 210, 212 open and close. The use of the bag gripping and manipulation members 218, 220 offers greater control in the bag filling process and helps to augment the fill rate of the bags themselves. A suitable bag gripping and manipulation member is described in U.S. Pat. No. 5,349,996. This patent is commonly assigned with the present application and is hereby incorporated by reference.

In many applications it is desirable to draw a vacuum within the bag 19 before the particulate material is sealed therein. This is especially desirable when the particulate material being placed in a bag 19 is a perishable food item such as coffee or a chemical that may react with air present within the bag 19. In order to allow a vacuum to be pulled within a bag 19 that is coupled to a spout 201, the spout 201 has been provided with a pair of vacuum probes 222. Each vacuum probe is disposed along the lateral edges of the clam shell halves 210, 212 adjacent the joint between the respective clam shell halves. As can be seen in FIG. 3, the vacuum probes 222 are rigidly secured to the flange 209 from which the clam shell halves 210, 212 are suspended. Each probe comprises an elongate tube 224 that is rigidly secured to the flange 209 by a fitting 226. The fittings 226, in addition to securing the tubes 224 to the flange 209, also provide a connection to a pressure source (not shown) which provides a negative pressure for drawing a vacuum within a bag 19. The pressure source may be a vacuum pump or, preferably a venturi assembly that allows readily available shop air to be used to generate a vacuum within the vacuum probes 222.

The tips 228 of the vacuum probes 222 are substantially co-linear with the lower lips of the clam shell halves 210, 212 when the clam shell halves 210, 212 are in their first, closed position. In this manner, when a bag 19 is placed over the spout 201 as illustrated in FIG. 1, the probe tips 228 will be disposed within the mouth of the bag 19. A suitable bag supply apparatus is indicated in FIG. 1 by reference numeral 40. As the bag supply apparatus 40 is described in detail in the aforementioned U.S. patent application Ser. No. 09/409,099, a bag supply apparatus will not be described herein. In addition, the operation sequence whereby a vacuum is drawn within a bag 19 will be described herein below.

Figure 2A:
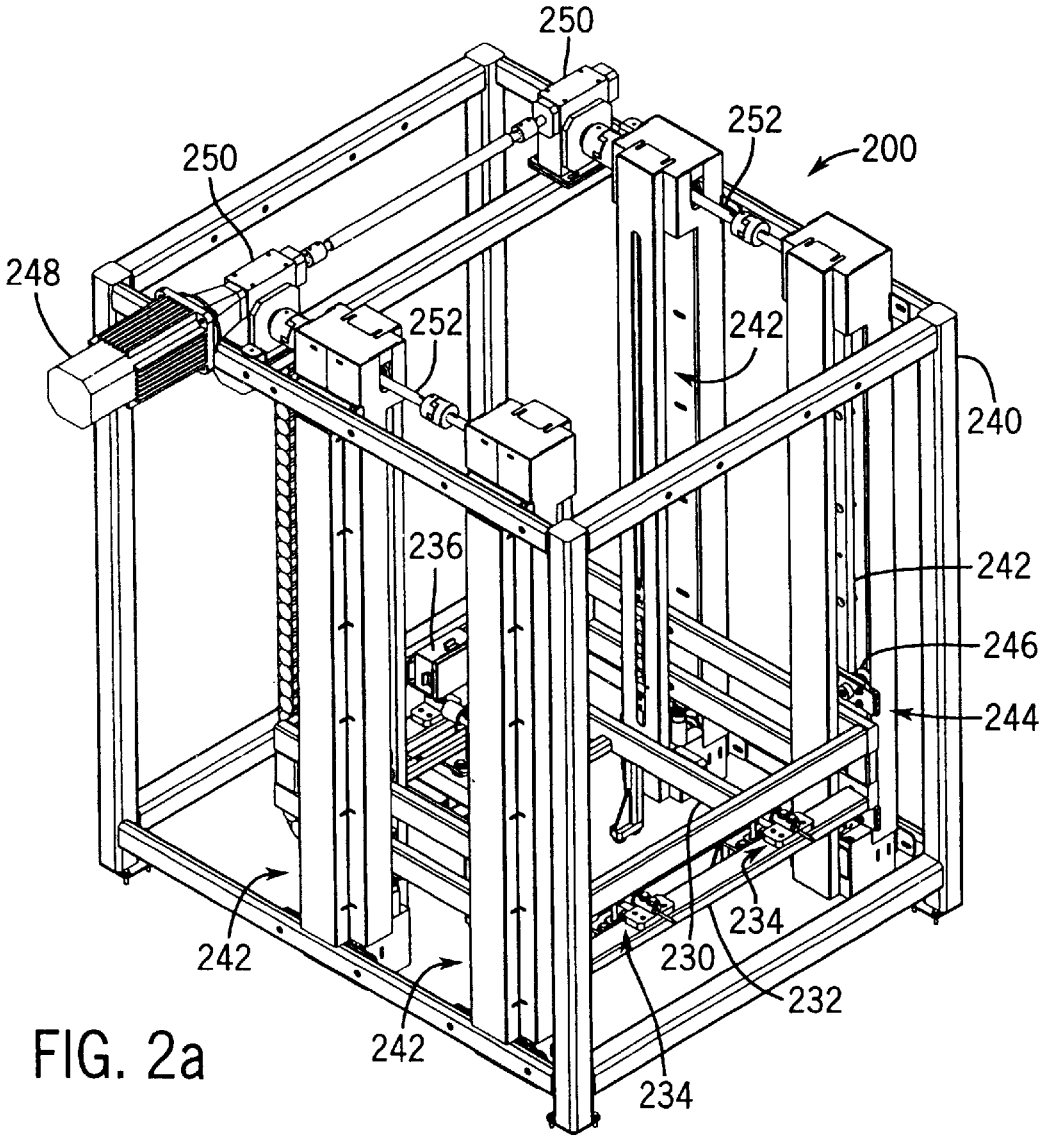
FIG. 2*a* is a perspective view of a moveable spout carriage that omits the bag filling spout illustrated in FIG. 3 in the interests of clarity.
Figure 2B:
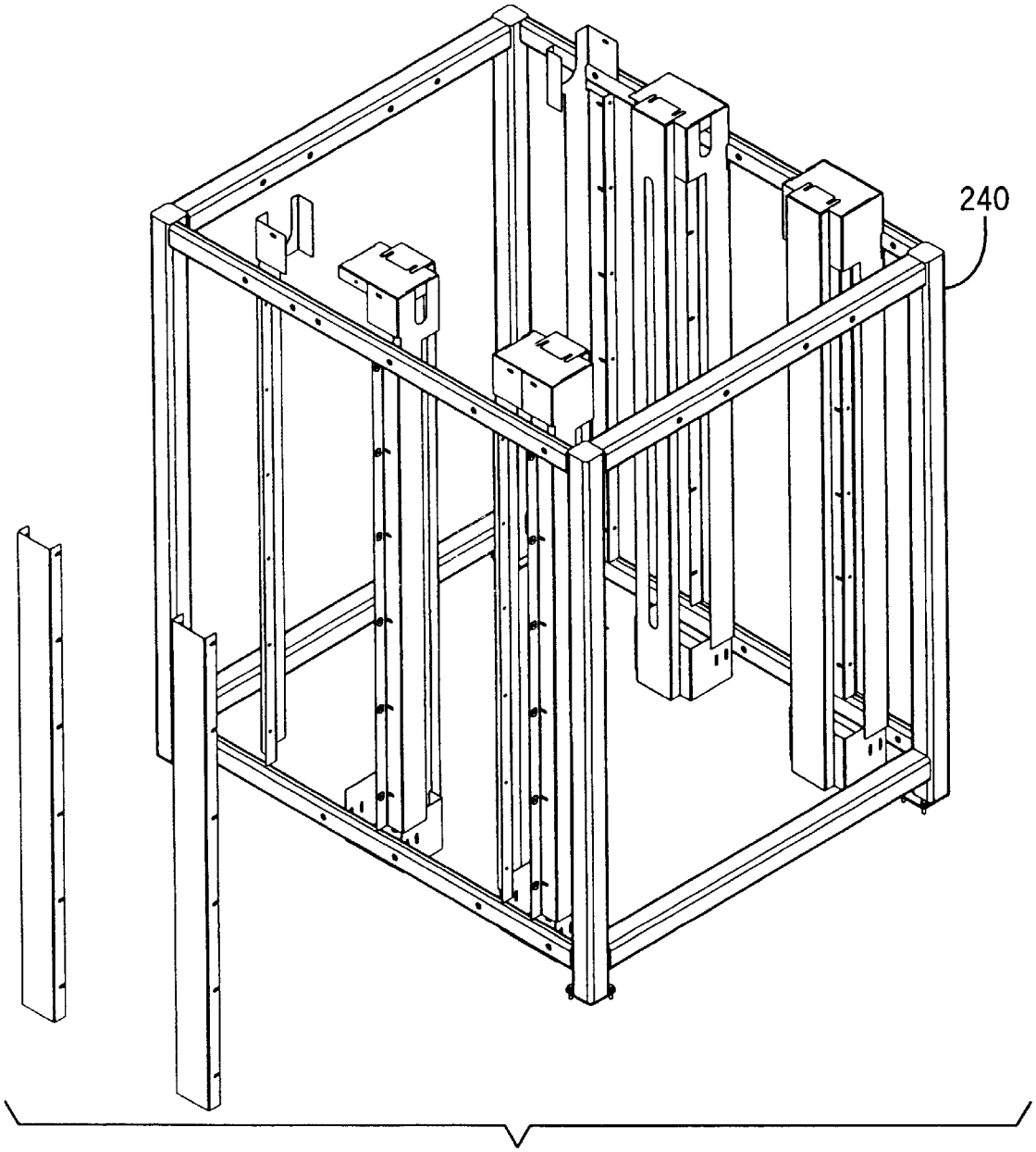
FIG. 2*b* is an exploded perspective view of the framework within which the moveable spout carriage is mounted.
Figure 2C:
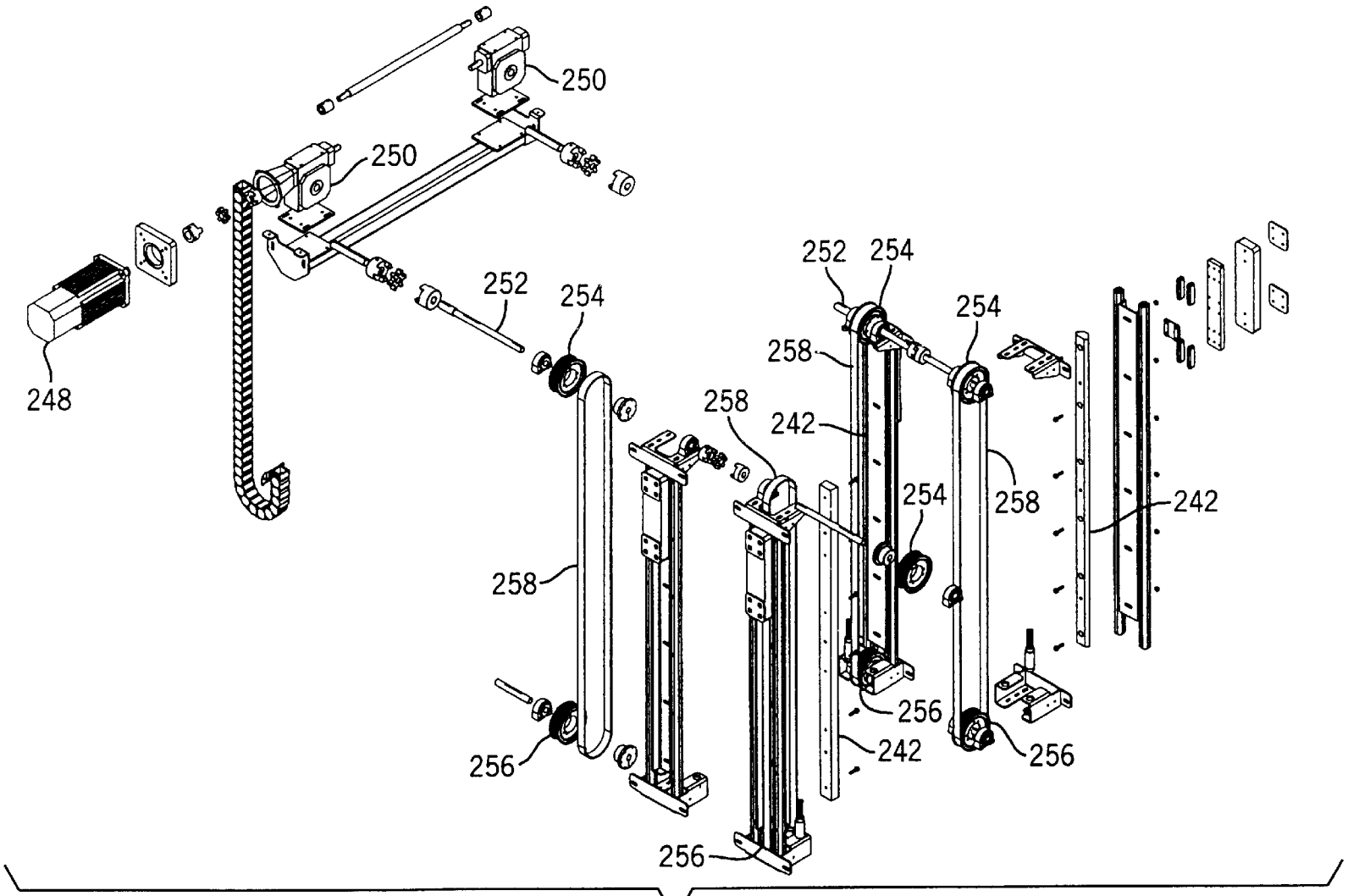
FIG. 2*c* is an exploded perspective view of the drive train that actuates the moveable spout carriage along with the vertical rails on which the moveable spout carriage rides.
Figure 2D:
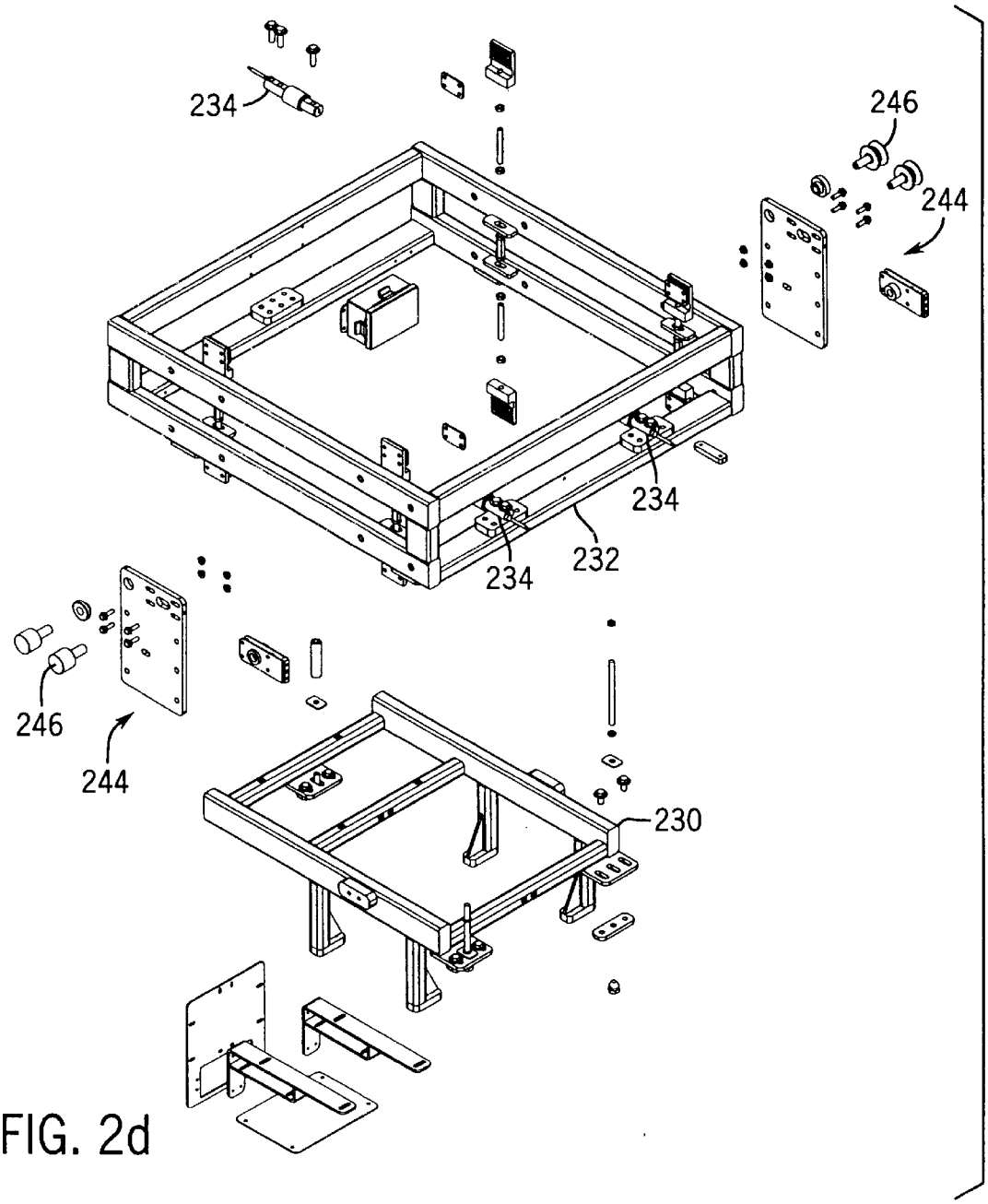
FIG. 2*d* is an exploded perspective view of the inner and outer frame of the moveable spout carriage, including the roller assemblies that ride upon the vertical rails illustrated in FIG. 2*c* and the load cell assemblies that connect the inner and outer frames.
Figure 2E:
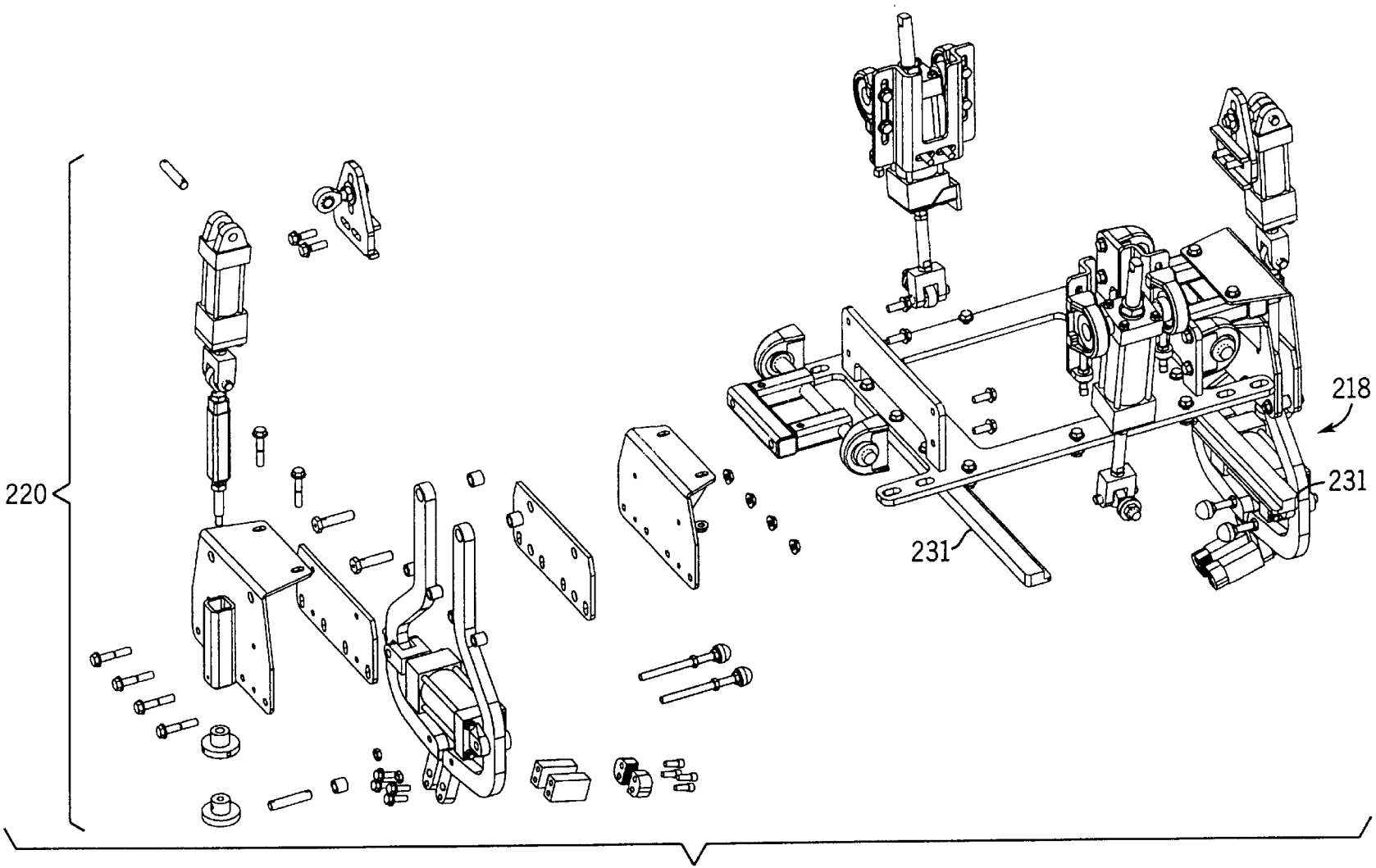
FIG. 2*e* is an exploded perspective view of the support rails that couple the bag filling spout to the inner frame of the moveable spout carriage, including the bag gripping and manipulation members and means for actuating the spout clamps of the bag filling spout.

The spout carriage 200 to which spout 201 is mounted is illustrated in FIGS. 2*a*–2*d*. Spout 201 may be coupled to an inner frame 230 by means of support rails 231 (FIG. 2*e*). Support rails 231 are themselves bolted to the inner frame 230 and allow a spout 201 to be easily mounted or dismounted from the spout carriage 200 as described in U.S. Pat. No. 5,349,996 to McGregor. The inner frame 230 is itself coupled to an outer frame 232 using a number of load cell structures 234 as illustrated in FIGS. 2*a* and 2*d*. As the spout 201 and inner frame 230 are suspended from the load cell structures 234, the particulate material placed in a bag 19 that is attached to the spout 201 may be weighed using a differential process in which the weight of the spout 201, bag 19 and inner frame 230 are subtracted from the total weight sensed by the load cell structures 234. Electrical signals relating to the weights of the inner frame 230, spout 201, bag 19 and the particulate material placed within the bag 19, are transmitted from the load cell structures 234 to a load cell electrical box 236 via electrical connections (not shown). The load cell electrical box 236 may process these electrical signals so as to calculate the net weight of the particulate material disposed within the bag 19, or the electrical signals may be transferred to a microprocessor (not shown) which will calculate and record the net weight of the particulate materials within the bag 19 that is clamped to the spout 201.

The outer frame 232 moves between a first, upper position and a second, lower position within a frame work 240 that is preferably disposed immediately below a supply hopper 68 (see FIG. 1). The outer frame 232 moves between its first and second positions along a plurality of vertical rails 242. In the embodiment illustrated in FIG. 2*a*, there are four vertical rails 242 that are secured to the frame work 240. Roller assemblies 244 are affixed to the exterior of the outer frame 232 so that rollers 246 in the roller assemblies 244 may engage the vertical rails 242. In order to ensure that the outer frame 232 and subsequently the spout 201 travel along a single linear path, it is preferred to provide at least two of the roller assemblies 244 with v-rollers which travel along vertical rails 242 having edges which mate with the v-rollers. The v-rollers do not permit lateral movement and therefore the outer frame 232 will be constrained to move in a single linear vertical path. The remaining roller assemblies 244 are provided with simple bearing rollers which travel along vertical rails 242 having flat surfaces. The simple bearing rollers and complimentary flat surfaced vertical rails will allow a limited amount of lateral motion, thereby compensating for any twist or bow in the opposing vertical rails that are arranged to mate with the v-roller roller assemblies 244.

Motive power for moving the spout carriage 200 between its first and second positions is provided by a motor 248. See FIGS. 2*a* and 2*c*. The motor 248 is coupled to a pair of gear boxes 250 which transmit the rotary motion from the motor 248 to shafts 252. Shafts 252 may be a single shaft or a plurality of shafts coupled together. Each of the shafts 252 has mounted thereon a pair of toothed wheels or cogs 254.

Each of the cogs 254 mounted on the shafts 252 have an opposing cog 256. The respective pairs of cogs 254, 256 are preferably mounted adjacent the vertical rails 242. Furthermore, the pairs of opposing cogs 254, 256 have passed there around a toothed belt 258 that because of the complimentary action between the teeth on the belt 258 and the teeth on the cogs 254 and 256, is constrained to move when the shafts 252 rotate cogs 254. Each of the toothed belts 258 is secured to the outer frame 232 by respective belt clamps 260. As can be appreciated, when motor 248 causes the shafts 252 to rotate, cogs 254 will also rotate. The rotation of the cogs 254 causes the belts 258 to move therewith, translating the rotary motion of the shafts 252 into the linear motion of belts 258. As the outer frame of the spout carriage 200 is coupled directly to the toothed belts 258, the linear motion of the toothed belts 258 is translated into linear motion of the spout carriage 200. As can be appreciated, gear boxes 250 are constructed and arranged such that rotation of the shaft 254 is coordinated and in sync.

Once the bags 19 have been filled, the bags 19 are removed from the spout 276, sealed, and placed on a conveying device by a bag handling and sealing apparatus 204. An embodiment of a suitable bag handling and sealing apparatus was disclosed in U.S. patent application Ser. No. 09/409,099. However, a preferred embodiment of a more versatile bag handling and sealing mechanism 204 is illustrated in FIGS. 5–10.

As can be seen in FIGS. 5–10, the forming bars 262, 264, have been provided with an inner liner sealing mechanism 274. This mechanism comprises a pair of inner liner sealing bars 276, 278 that are rotated between a first, inoperative position (illustrated in FIG. 6) and a second, operative position (illustrated in FIG. 7) by a pair of cam plates 280 mounted between the side plates 270, 272. The preferred embodiment of the present invention further comprises an improved fold over mechanism 326 mounted to crimping bar 268.

Because the sides of the bag sealing mechanism 204 are substantially mirror images of one another, FIGS. 5–10 show only one side of the mechanism 204. FIGS. 5–10 are cut away drawings of the bag sealing mechanism 204 viewed parallel to the forming and crimping bars.

The heat sealing mechanism 274 comprises a pair of opposing inner liner sealing bars 276, 278 rotatively and opposably mounted upon respective pairs of U-shaped arms 282, 284 and 286, 288. The respective pairs of U-shaped arms 282, 284 and 286, are rotatively mounted, as by bearings 290, between the leg members 292, 294 and 2272, 298 that support forming bars 262, 264. The inner lining sealing bars 276, 278 are pivoted between their first and second positions by cam plates 280. Cam plates 280 are affixed to the pistons 300 of a pair of two-way power cylinders 302 each of which is secured to the inner surface of a respective side plate 270 and 272. The inner lining sealing bars 276, 278 are symmetrically opposable and engage one another to clamp therebetween the bag 19. The location at which the sealing bars 276, 278 engage the bag 19 is preferably above the location at which the forming bars 262, 264 actually grip and support the filled bag 19. It must be understood however, that the inner liner sealing bars 276, 278 may be arranged, if so required, to engage a bag 19 below the location where the forming bars 262, 264 have gripped the bag 19 to hold it for sealing.

The inner liner sealing bars 276, 278 have faces formed to securely clamp the bag top therebetween and are preferably heated as by electrical resistance to heat seal the inner liner of a bag 19 at the line defined across the bag top by the inner liner sealing bars 276, 278. It is important to note that the sealing bars 276, 278 seal the inner liner of bag 19 at a location that is offset from the location at which the top of the bag 19 is crimped to allow it to be folded over. Preferably the inner liner of the bag 19 is sealed at a location below the transverse crease C formed into the bag top 19*a*, however, it must be understood that it is within the purview of this invention for the sealing bars 276, 278 to seal the inner liner of the bag 19 above the transverse crease C created by crimping bars 266, 268.

Figure 5:
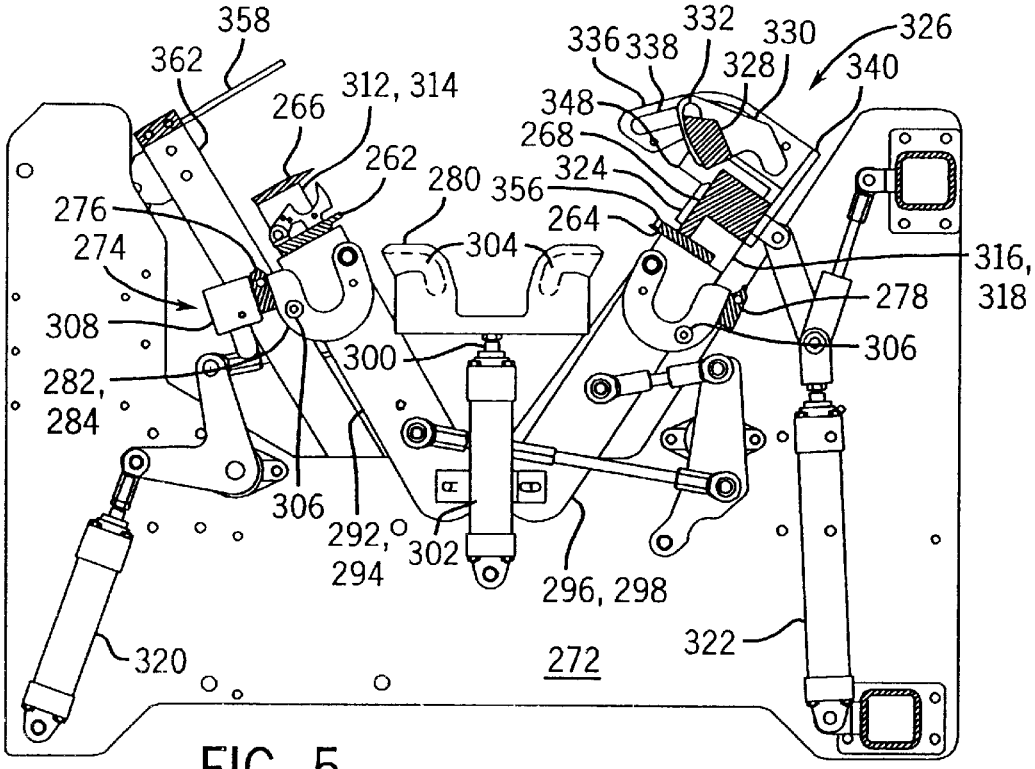
FIG. 5 is a cut away interior elevation of the bag handling and sealing mechanism wherein the forming, crimping, sealing and settling bars are in their first, inoperative positions.
Figure 6:
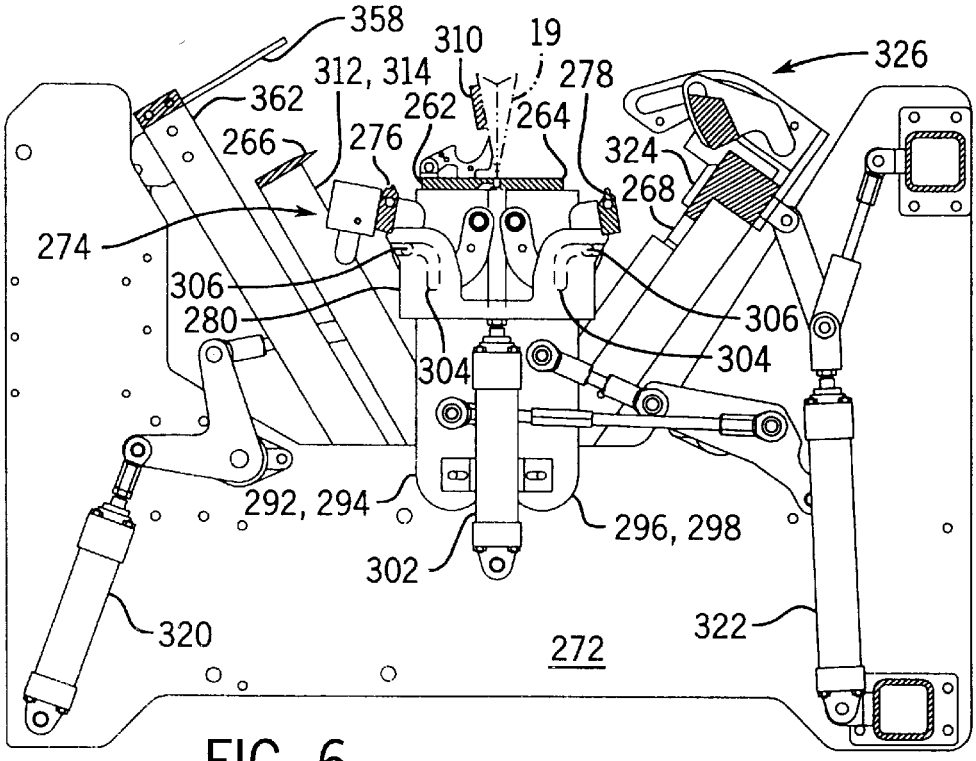
FIG. 6 is a cut away interior elevation of the bag handling and sealing mechanism wherein the forming bars have been rotated to their second, operative positions and the crimping, sealing and settling bars are in their first, inoperative positions.
Figure 6A:
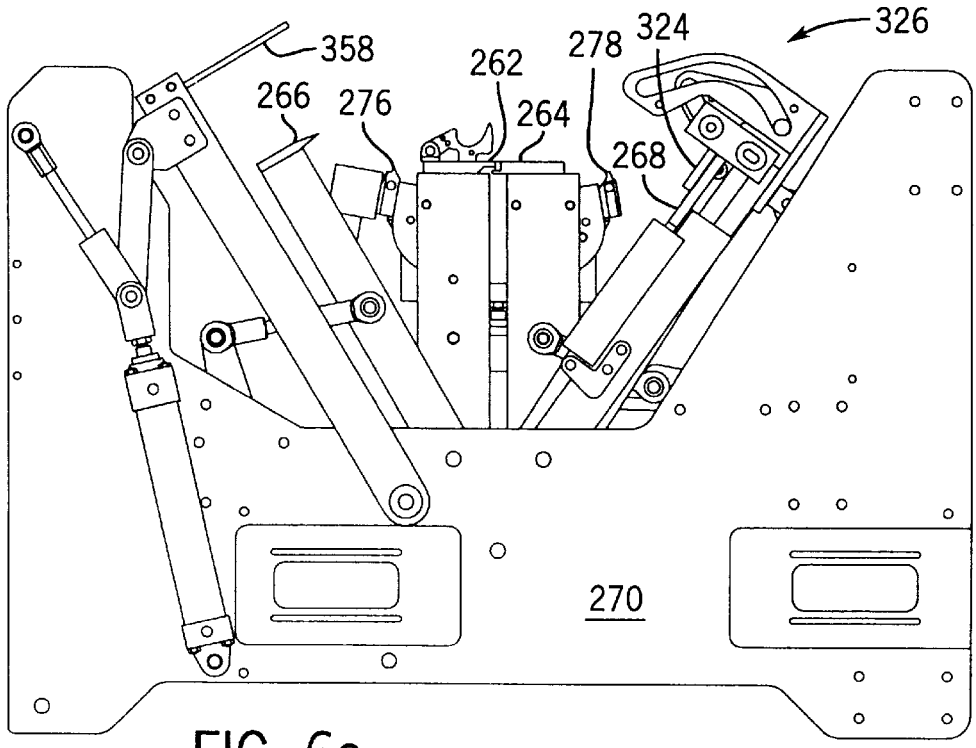
FIG. 6*a* is an exterior side elevation of the bag handling and sealing mechanism of FIG. 6.

Each of the cam plates 280 have symmetric cam follower grooves 304 formed into the surfaces of the cam plates 280 that face respective side plates 270, 272. The cam plates 280 are arranged such that when the cam plates 280 are in their first, lower position, and the forming bar 262, 264 have been rotated to their second, closed position, cam bearings 306 on each of the arms 282–288 are received in respective cam follower grooves 304. When the forming bar 262, 264 are in their open positions, cam bearings 306 are completely clear of the cam follow grooves 304 of the cam plates 280. As can be seen in FIGS. 5 and 6, when the cam plates 280 are in their first, inoperative position, the sealing bars 276, 278 are located below and clear of the crimping bars 266, 268.

Figure 7:
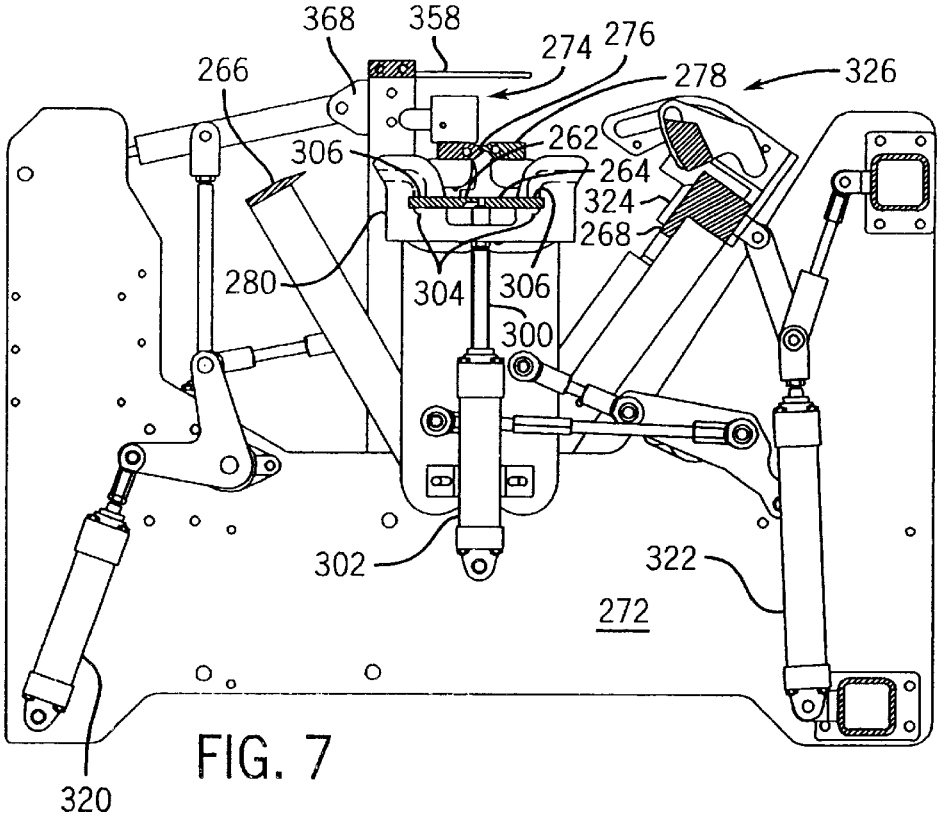
FIG. 7 is a cut away interior elevation of the bag handling and sealing mechanism wherein the forming and sealing bars have been rotated to their second, operative positions and the crimping and settling bars are in their first, inoperative positions.

The extension of piston 300 of cylinder 302, as shown in FIG. 7, moves the cam plates 280 to their second, upper and engaged position in which the cam follower grooves 304 in the cam plates 280 engage cam bearings 306 secured to each of the inner liner sealing bar arms 282–288. As the cam plates 280 are moved upwardly by cylinders 209, the shape of the cam follower grooves 304 forces the cam bearings 306 engaged therein to move inwardly and upwardly, thereby pivoting the inner liner sealing bars 276, 278 from their first, inoperative position to their second, operative position in which the heated inner liner sealing bars 276, 278 engage the bag 19 to seal the inner liner of the bag 19. After a predetermined dwell time has passed, pistons 300 of cylinders 302 are retracted, thereby lowering the cam plates 280 to their lower positions and rotating inner liner sealing bars 276, 278 back to their first, inoperative position.

A heater manifold 308 is secured to the top of sealing bar 276. This manifold, which may be a hot air or radiant heating device, activates the adhesive 310 used to hold the folded over top flap 19*a* of the bag 19 closed. Activation of the adhesive 310 on the bag top 19*a* is accomplished simultaneously with the sealing of the inner lining of the bag 19 by inner liner sealing bars 276, 278.

The crimping bars 266, 268 are independently rotatively supported upon legs 312, 314 and 316, 318, respectively. The crimping bars 266, 268 are rotated between first, bag release positions and second, bag engaging positions by means of the linkages and power cylinders described in detail in U.S. application Ser. No. 09/409,099. When power cylinders, 320, 322 are actuated to extend their pistons, the crimping bars 266, 268 rotate from their first, bag release positions, to their second, bag engaging positions. The face of crimping bar 266 has, in this embodiment, a knife edge that is arranged to directly oppose an elastomeric pad 324 applied to the face of the crimping bar 268. When the crimping bars 268, 268 engage the bag 19, the knife edge of crimping bar 266 forces the bag top 19*a* into the elastomeric pad 253 so as to form the transverse crease C in the bag top. Once the crease C has been formed in the bag top, cylinder 320 is retracted to move the crimping bar 266 back to its first position. When the crimping bar 266 has cleared the bag top 19*a*, the fold over mechanism 326 is activated to fold over and close the bag top 19*a*.

The fold over mechanism 326 comprises a fold over bar 328 secured between a pair of eccentric mounting plates 330. Each eccentric mounting plate 330 has a curvilinear cam slot 332 formed therein that is, in this embodiment, substantially congruent with the face of the fold over bar 328. Opposite the cam slot 332, each eccentric mounting plate 330 has extending outwardly away from the fold over bar 328 a cam bearing 334. The cam bearings 334 of each eccentric mounting plate are received and retained in respective curvilinear cam slots 338 formed in a pair of side mounting plates 336. These side mounting plates 336 extend along and outside of the eccentric mounting plates 330 and are supported by respective brackets 340 that are secured to crimping bar 268.

Figure 8:
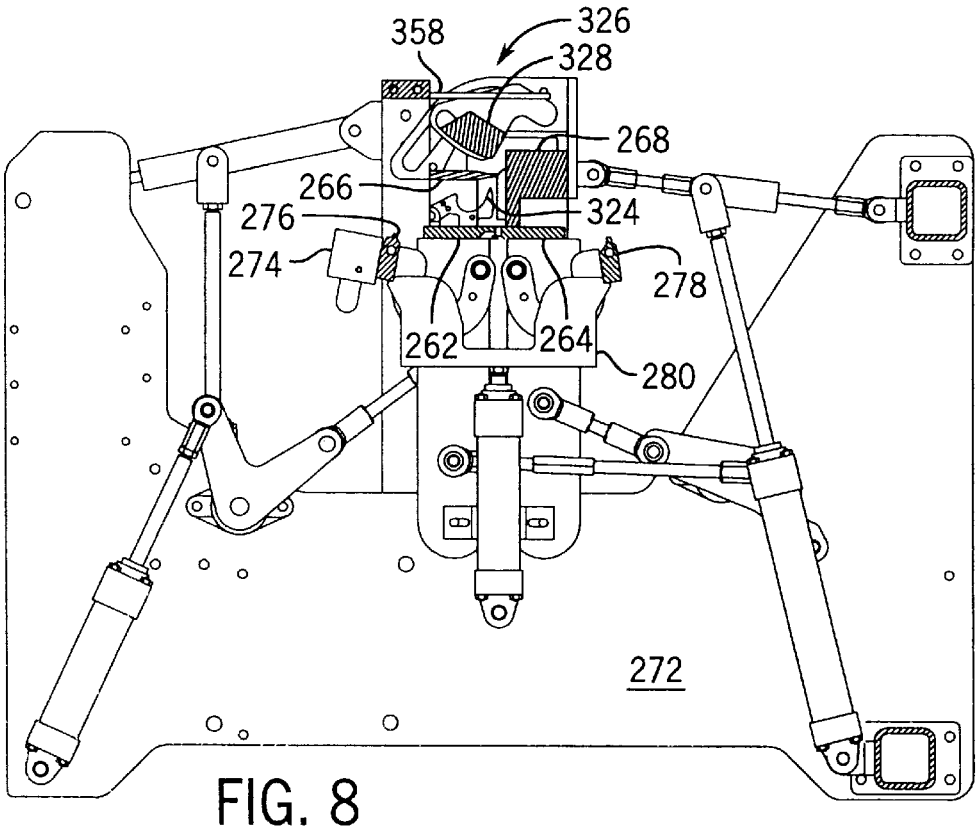
FIG. 8 is a cut away interior elevation of the bag handling and sealing mechanism wherein the forming, crimping and settling bars have been rotated to their second, operative positions and the sealing bars have been rotated back to their first inoperative position.
Figure 8A:
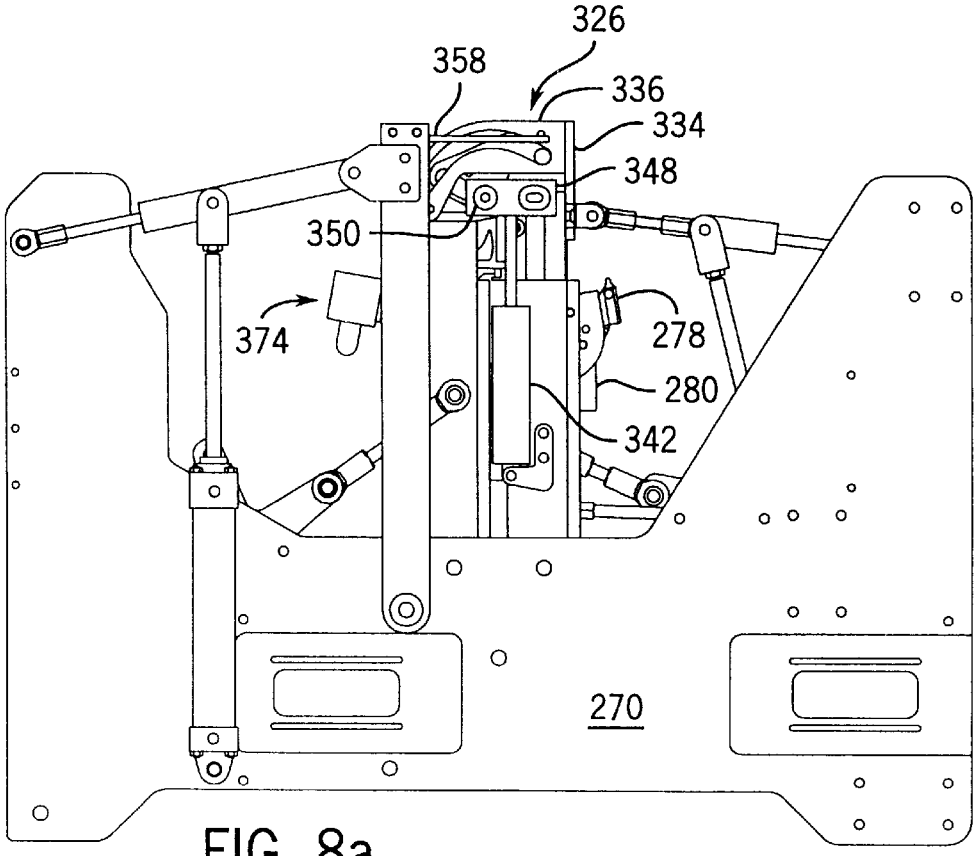
FIG. 8*a* is an exterior side elevation of the bag handling and sealing mechanism of FIG. 8.
Figure 10:
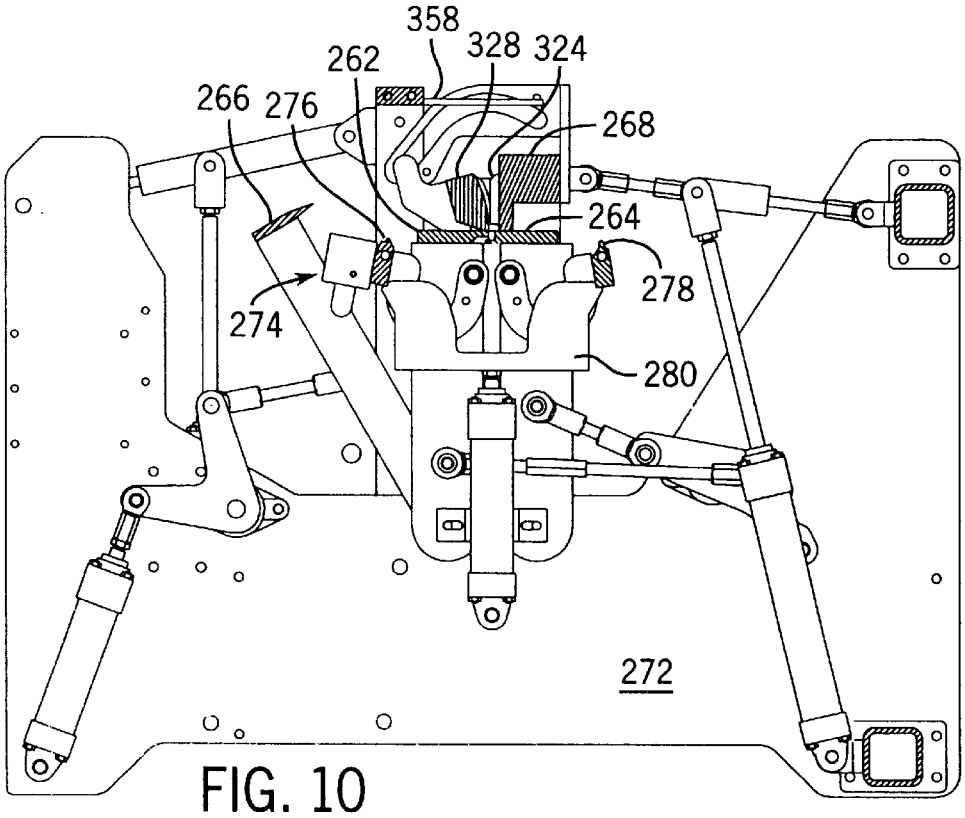
FIG. 10 is a cut away interior elevation of the bag handling and sealing mechanism wherein the forming, and settling bars have been rotated to their second, operative positions and wherein the sealing bars and the knife edged crimping bar have been moved back to their first inoperative positions and wherein the fold over mechanism has been actuated to its operative position to fold over the top of the bag being sealed.
Figure 10A:
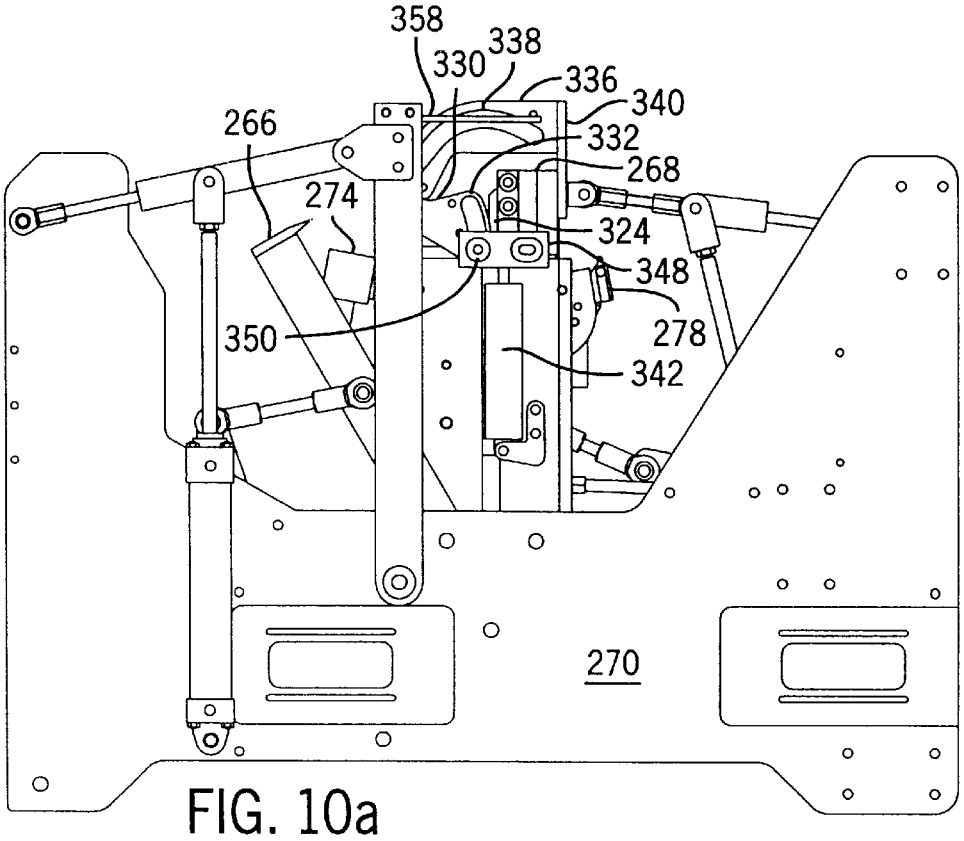
FIG. 10*a* is an exterior side elevation of the bag handling and sealing mechanism of FIG. 10; and, FIG. 11 is a partial plan view of the forming bars in their second, operative positions showing how the bag is clamped between the forming bars with the vacuum probes inserted into the mouth of the bag.
Figure 11:
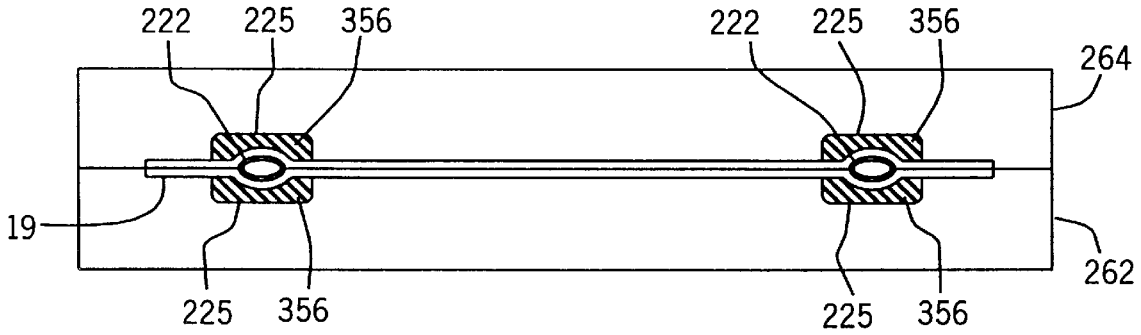

In order to achieve a uniformly and securely closed bag top, the fold over bar 328 is rotated between its first position, illustrated in FIG. 8, and its second position, illustrated in FIG. 10. As can be seen in FIG. 10, the fold over bar 328 is rotated downwardly and into contact with the elastomeric pad 324 applied to the face of crimping bar 268. Rotation of the fold over bar 328 is actuated by a pair of power cylinders 342 that are secured at their bases to the outer side of legs 316, 318 by brackets 346. Rectangular plates 348 are secured to the pistons 344 of each of the cylinders 342. Each of the rectangular plates 348 has first and second cam bearings 350, 352 secured thereto and extending inwardly toward the eccentric mounting plates 330. First cam bearing 350 is received and retained in cam slot 332 of the eccentric mounting plate 330. Second cam bearings 352 bear against projections 354 that are best seen in FIG. 10*a*. Projections 354 extend downwardly from the crimping bar 268 along the outer surfaces of legs 316, 318. Projections 354 ensure that the rectangular plate 348 moves between their first, extended positions and second, retracted positions along a straight line. When the rectangular plates 348 are in their first, extended positions, the fold over bar 328 is in its first, open position as illustrated in FIGS. 8 and 8*a*. And when cylinders 342 have been actuated to retract their pistons 344, the rectangular plates 348 are moved to their second, retracted positions and consequently rotating the fold over bar 328 into its second, closed position as illustrated in FIGS. 10 and 10*a*. It should be noted that the cooperation between cam slot 338 and cam bearing 334 and cam slot 332 and cam bearing 350 cause the fold over bar 328 to be rotated between its first and second positions along a complex curvilinear path rather than about a single axis of rotation. The curvilinear rotation of the fold over bar 328 moves the fold over bar 328 slightly outward beyond the crease C formed by the crimping bars 266, 268 to contact the bag top 19*a* slightly above the crease C. The contact between the fold over bar 328 and the bag top 19*a* away from the crease C gives more leverage in folding the bag top 19*a* into contact with the face of the bag 19. In addition, as can be most clearly seen in FIG. 10, the face of the fold over bar 328 rotates past vertical to exert sealing pressure on the folded over bag top 19*a*. This sealing pressure is augmented by the fact that the fold over bar 328 is compressing the folded over bag top into the elastomeric pad 324 applied to the face of the crimping bar 268. The elastomeric pad 324 acts to distribute more evenly the pressure being applied by the fold over bar 328, thereby ensuring that the heat activated adhesive 310 will secure the folded over bag top 19*a* to the face of the bag 19 over a larger area of the bag 19. After a predetermined dwell time as elapsed, cylinders 342 extends their pistons 344 to rotate the fold over bar 328 back to its first, open position.

As indicated above, the spout 201 may also be provided with one or more vacuum probes 222. These vacuum probes 222 extend downwardly from the spout 201 and are disposed within the mouth of the bag 19 that is clamped to the spout 201 during filling. In order to draw a vacuum with the bag 19, it is first necessary to clamp the mouth of the bag 19 around the vacuum probes 222. As the mating faces of the forming bars 262, 264 are typically fashioned of a material such as steel or aluminum, it is necessary to form notches 225 in the forming bars 262, 264 in locations that correspond to the positions of the vacuum probes 222 as illustrated in FIG. 3*a*. In addition, it is necessary to provide a resilient seal 356 on one or both of the forming bars so that when the mouth of the bag 19 is clamped between the forming bars 262, 264 and around the vacuum probes 222, an airtight seal is created. Activation of the pressure source causes air within the bag 19 to be withdrawn by the vacuum probes 222, thereby creating a vacuum within the bag 19. The tips 228 of the vacuum probes are substantially rigid and are preferably covered in a heat resistant, durable, and relatively slippery material such as Teflon ®. The tips 228 of the vacuum probes 222 are preferably elliptical in cross section, thereby minimizing the size of the notches 225 required in the forming bars 262, 264. Furthermore, the tips 228 of the vacuum probes 222 are preferably rounded to avoid tearing the bags 19 as they are addressed to the spout 201 by the bag hanging mechanism 40.

Figure 5A:
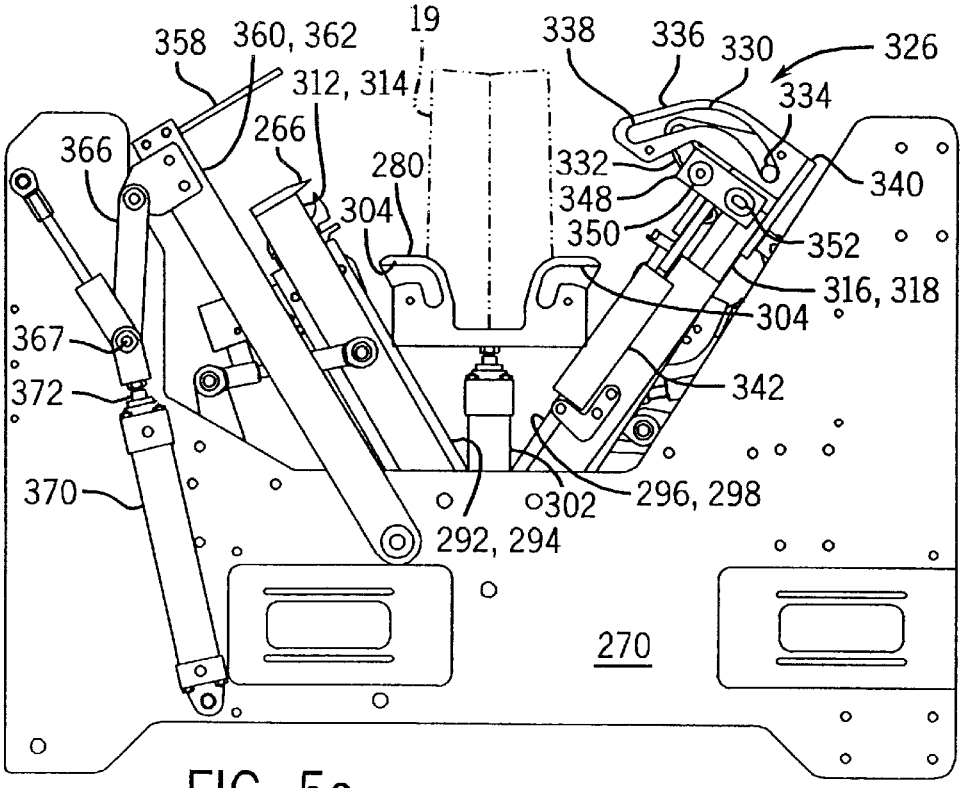
FIG. 5*a* is an exterior side elevation of the bag handling and sealing mechanism of FIG. 5.
Figure 7A:
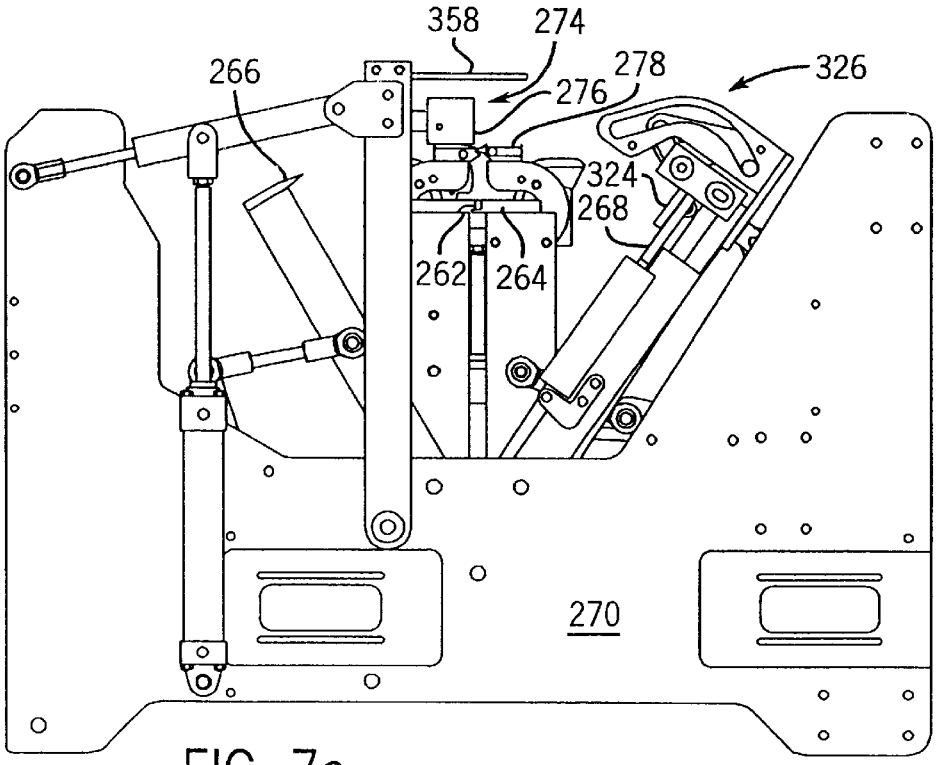
FIG. 7*a* is an exterior side elevation of the bag handling and sealing mechanism of FIG. 7.
Figure 9:
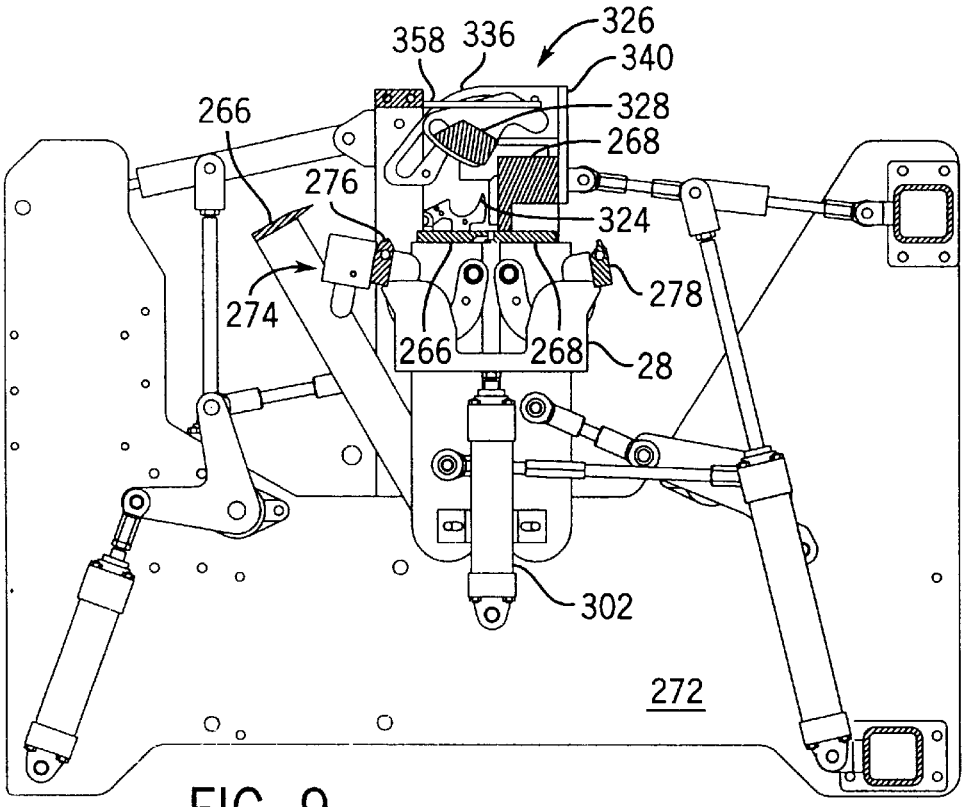
FIG. 9 is a cut away interior elevation of the bag handling and sealing mechanism wherein the forming, and settling bars have been rotated to their second, operative positions and wherein the sealing bars and the knife edged crimping bar have been moved back to their first inoperative positions.
Figure 9A:
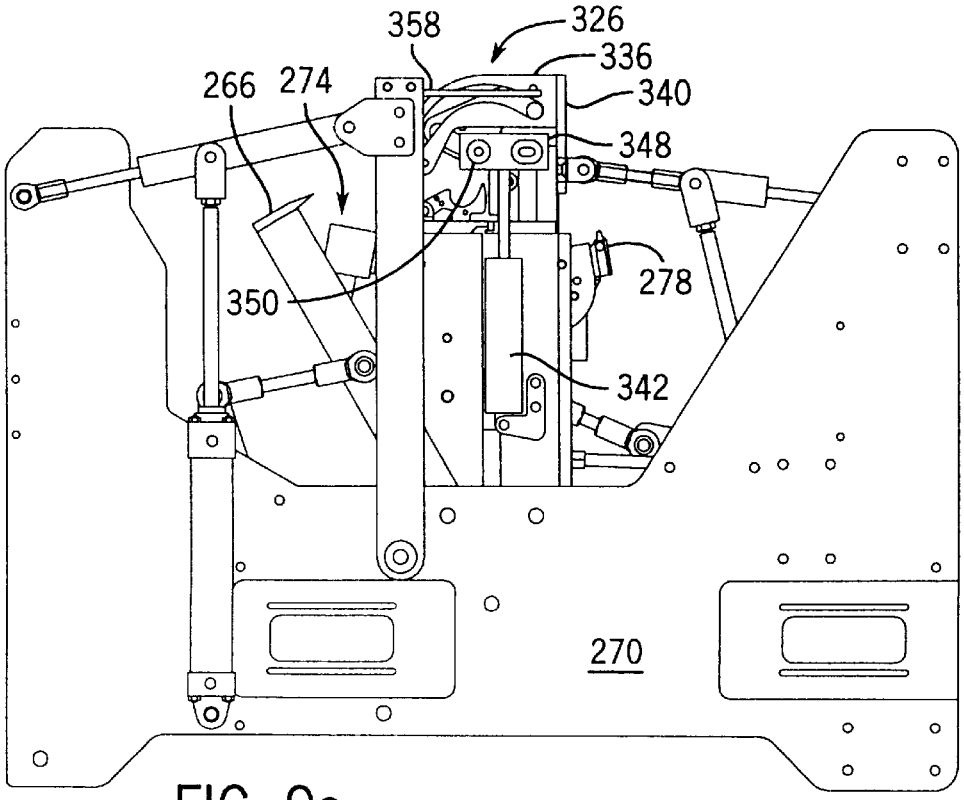
FIG. 9*a* is an exterior side elevation of the bag handling and sealing mechanism of FIG. 9.

Once a vacuum has been drawn in the bag 19, the bag handling and sealing apparatus 204 begins to move downward, thereby withdrawing the tips 228 of the vacuum probes 222 from between the forming bars 262, 264 and the mouth of the bag 19. The seal 356 snaps back around the tips 228 of the vacuum probes 222 as they are withdrawn to maintain an airtight seal at the mouth of the bag. Once the bag handling and sealing apparatus 204 has moved sufficiently downward to clear the spout 201, cylinders 302 extend their pistons 300 as described above to bring the sealing bars 276, 278 into sealing contact with the bag 19 to seal it. Where the bag 19 is a paper bag with a plastic liner, sealing bars 276, 278 will seal the liner and heat sealing mechanism 274 will simultaneously activate the adhesive 310 on the outside of the bag mouth so that crimping bars 266, 268 and fold over mechanism 326 can fold over and seal the paper outer layer of the bag. And where the bag 19 is a plastic bag, the sealing bars 276, 274 will seal the bag and heat sealing mechanism 274, crimping bars 266, 268, and fold over mechanism 326 will remain inoperative.

Where the vacuum probes 222 will not be used in a bag filling and sealing operation, settling bar 358 may be used to remove excess air from the particulate material being placed in a bag 19. Settling bar 358 is supported on a pair of pivotable legs 360, 362 that are mounted to the exterior of side plates 270, 272. As can be seen in FIGS. 8–10, the legs 360 and 362 are sufficiently long so that the settling bar 358 may be rotated into is operative position above the forming and crimping bars without adversely affecting the operation of the forming or crimping bars. FIG. 5*a* illustrates the linkage 364 that actuates the settling bar 358 between its inoperative position to the left and its operative position above the forming and crimping bars as illustrated in FIG. 7*a*. A two bar link 366 is pinned to the exterior of side plate 270 and to a bracket 368 on leg 360. Cylinder 370 is also rotatively pinned to exterior of side plate 370. The piston 372 of cylinder 370 is in turn pinned to the joint 367 of the two bar link 366. When piston 372 is retracted as illustrated in FIG. 5*a*, the settling bar is in its inoperative position and when the piston 372 is extended, the settling bar is rotated into is operative position as illustrated in FIG. 7*a*. In operation, the settling bar 358 is moved to its operative position above the crimping and forming bars and is brought into contact with a bag 19 clamped on spout 201 by the bag handling and sealing mechanism. This contact acts to remove air from particulate materials being placed in the bag 19. The bag handling and sealing mechanism 204 may also be reciprocated to cause the bag settling arm 358 to repeatedly strike the bottom of the bag 19 on spout 201. Typically contact between the bag 19 and settling bar 358 occurs as the bag handling and sealing mechanism 204 is on its upward travel to grasp a bag 19 clamped to the spout 201.

Operational Sequence

In operation a bag 19 is addressed to the spout 201 by a bag hanging mechanism 40 and secured to the spout by spout clamps 214, 216. Simultaneously, bag gripping and manipulation members 218, 220 will grasp the top of the bag 19 near its sides.

When the bag 19 has been securely grasped by the spout clamps 214, 216 and bag gripping and manipulation members 218, 220, the spout clamshell halves 210, 212 will rotate away from another and the spout carriage 200 will begin its upward travel along vertical rails 242 from its first, lower position, to its second, upper position. The bag gripping and manipulation members 218, 220 will also move to their bag filling position adjacent the spout. As the spout carriage 200 moves upward to its second position, the stationary slip tube or vertical auger 202 is inserted through the open spout 201 and into the bag 19, the lower end of the slip tube 202 being disposed near the bottom of bag 19 when the spout carriage 200 reaches its uppermost position.

Once the spout carriage 200 has reached its uppermost position, a predetermined quantity of particulate material is discharged through the slip tube 202 and into the bag 19. As the bag 19 fills, the spout carriage 200 begins to move back to its lower most position, effectively filling the bag 19 in the manner known as bottom filling. Simultaneously with the downward travel of the spout carriage 200, the bag handling and sealing mechanism 204 begins its upward travel. Where required, the settling bar 358 will be moved into its operative position as illustrated in FIGS. 7 and 7*a*. The upward motion of the bag handling and sealing mechanism 204 and simultaneous downward motion of the spout carriage 200 will bring the settling bar 358 into gentle contact with the bottom of bag 19. At this time, the bag handling and sealing mechanism may be reciprocated or jogged to repeatedly contact the bottom of the bag 19. Once contact has been made between the settling bar 358 and the bottom of bag 19, the settling bar 358 is actuated to rotate to is inoperative position so that bag 19 may be lowered into the bag handling and sealing mechanism 204 as illustrated in FIG. 5.

Once a predetermined charge of particulate material is placed in the bag (as determined by the load cell structures 234) and the spout carriage 200 has moved sufficiently downward that the stationary slip tube 202 is withdrawn from the spout 201, the spout clamshell halves 210, 212 rotate to their closed positions and the bag gripping and manipulation members 218, 220 will move to their bag grasping and release positions, away from the spout 201.

Once the spout carriage 200 and the bag handling and sealing mechanism 204 have reached their lowermost and uppermost positions, respectively, the forming bars 262, 264 of the bag handling and sealing mechanism 204 rotate inwardly to firmly grasp the sides of the bag 19. Where the spout 201 and bag handling and sealing mechanism 204 have been provided with vacuum probes 222 and forming bars 262, 264 with corresponding notches 225, the forming bars 262, 264 will clamp the mouth of the bag 19 around the vacuum probes 222. At this point, a pressure source will be activated and a vacuum will be drawn within the full bag 19 through the vacuum probes 222. During or immediately after the vacuum has been drawn within the bag 19, the spout clamps 214, 216 and bag gripping and manipulation members 218, 220 release their hold on the bag 19 and the bag handling and sealing mechanism 204 begins to travel downward toward its bag release position. This downward travel acts to withdraw the vacuum probes 222 from the mouth of the bag 19.

Whether the spout 201 has been provided with vacuum probes 222, once the bag handling and sealing mechanism 204 has cleared the spout 201, sealing bars 276, 278 are rotated into sealing contact with the sides of the bag 19. Where the bag 19 is to further be folded over, heat sealing mechanism 274 heats the side of bag 19 to activate an adhesive 310 on the side of bag 19. Once a predetermined dwell time has passed, the sealing bars 276, 278 are retracted and the crimping bars 266 and 268 are actuated to crimp and fold over the top of bag 19.

The knife edge of crimping bar 266 presses the bag side against resilient pad 324 on crimping bar 268 to form crease C in the bag top. Crimping bar 266 is then returned to its first, inoperative position and fold over mechanism 326 is actuated to rotate fold over bar 328 into contact with the bag top above the crease C. Fold over bar 328 forces the bag top above crease C into contact with the adhesive 310 applied to the bag 19 and compresses the folded over bag top against resilient pad 324 to ensure good adhesion. Fold over mechanism 326 then rotates the fold over bar 328 back to its first position and crimping bar 268 is rotated back to its first position.

When the bag handling and sealing mechanism 204 reaches its lowermost position, forming bars 262, 264 release bag 19 onto a conveying device the removes the filled and sealed bag 19 from the bag filling and sealing device. The bag handling and sealing mechanism 204 then begins to move upward to address a subsequent bag 19 clamped to the spout 201.

The invention described above may be embodied in other forms without departing from the spirit or essential characteristics thereof. The embodiments disclosed in this application are to be considered in all respects as illustrative and not restrictive. The scope of the invention is indicated by the appended claims rather than by the foregoing description and all changes which come within the meaning and range of equivalency of the claims are intended to be embraced therein.

What is claimed is:

1. An apparatus for vacuum filling and sealing bags comprising:

a material dispensing spout having a discharge end defined by closure members operable between closed and open positions for discharging particulate material into a bag;

an actuator means positioned and arranged to open and close the spout discharge end closure members;

clamping members on the spout discharge end movable between a closed position in clamping engagement with a bag mouth on the spout discharge end and an open position;

a vacuum probe disposed along said material dispensing spout such that said vacuum probe will be disposed within said bag mouth when said bag mouth is positioned on said spout discharge end, said vacuum probe having fluidically coupled thereto a source of negative pressure for drawing a vacuum with said bag; and, a carriage movable in a travel path between a first, bag receiving position in close proximity to the spout discharge end and a second, bag discharge position away from the spout;

sealing apparatus mounted on the carriage and movable between a first, inoperative position and a second position in sealing juxtaposition with said bag mouth, whereby bags may be clamped on the spout and filled one at a time, and thereafter released by the spout clamping members for movement by the carriage to a release position, with the bag mouth being sealed by the sealing apparatus as the carriage moves between its first and second positions, said sealing apparatus further comprising:

a pair of opposable forming bars for gripping and supporting said bag rotatively disposed between a pair of parallel side plates;

said forming bars being constructed and arranged to resiliently seal said bag mouth in an airtight manner around said vacuum probe when said carriage is in close proximity to the spout discharge end of said spout; and, said forming bars having rotatively mounted thereunder a pair of sealing bars, said sealing bars being arranged and constructed to rotate between a first position in which said sealing bars are rotated away from said bag and a second position in which said sealing bars engage said bag to heat seal said bag.

2. The apparatus for vacuum filling and sealing bags of claim 1 further comprising:

a settling bar rotatively coupled to said carriage;

said settling bar being constructed and arranged to be positioned so that said settling bar may contact said bag as said carriage is moved into its first, bag receiving position.

3. An apparatus for vacuum filling and sealing bags comprising:

a material dispensing spout having a discharge end defined by closure members operable between closed and open positions for discharging particulate material into a bag;

an actuator means positioned and arranged to open and close the spout discharge end closure members;

clamping members on the spout discharge end movable between a closed position in clamping engagement with a bag mouth on the spout discharge end and an open position;

a vacuum probe disposed along said material dispensing spout such that said vacuum probe will be disposed within said bag mouth when said bag mouth is positioned on said spout discharge end, said vacuum probe having fluidically coupled thereto a source of negative pressure for drawing a vacuum with said bag; and, a carriage movable in a travel path between a first, bag receiving position in close proximity to the spout discharge end and a second, bag discharge position away from the spout;

sealing apparatus mounted on the carriage and movable between a first, inoperative position and a second position in sealing juxtaposition with said bag mouth, whereby bags may be clamped on the spout and filled one at a time, and thereafter released by the spout clamping members for movement by the carriage to a release position, with the bag mouth being sealed by the sealing apparatus as the carriage moves between its first and second positions, said sealing apparatus further comprising;

a pair of opposable forming bars for gripping and supporting said bag rotatively disposed between a pair of parallel side plates;

said forming bars being constructed and arranged to resiliently seal said bag mouth in an airtight manner around said vacuum probe when said carriage is in close proximity to the spout discharge end of said spout; and, a pair of sealing bars rotatively mounted within the carriage, said sealing bars being arranged and constructed to rotate between a first position in which said sealing bars are rotated away from said bag and a second position in which said sealing bars engage said bag to heat seal said bag.

* * * * *